US005499038A

United States Patent [19]

DiSanto et al.

[11] Patent Number: 5,499,038

[45] Date of Patent: * Mar. 12, 1996

[54] METHOD OF OPERATION FOR REDUCING POWER, INCREASING LIFE AND IMPROVING PERFORMANCE OF EPIDS

[75] Inventors: Frank J. DiSanto, North Hills; Denis A. Krusos, Lloyd Harbor, both of N.Y.

[73] Assignee: Copytele, Inc., Huntington Station, N.Y.

[ * ] Notice: The portion of the term of this patent subsequent to Sep. 21, 2010, has been disclaimed.

[21] Appl. No.: 180,197

[22] Filed: Jan. 11, 1994

Related U.S. Application Data

[60] Continuation of Ser. No. 12,739, Feb. 3, 1993, abandoned, which is a division of Ser. No. 795,659, Nov. 21, 1991, Pat. No. 5,247,290.

[51] Int. Cl.[6] ..... G09G 3/34

[52] U.S. Cl. ..... 345/107; 345/212; 359/296

[58] Field of Search ..... 345/107, 211, 345/212; 359/296

[56] References Cited

U.S. PATENT DOCUMENTS 5,053,763 10/1991 DiSanto et al. ..... 340/787

*Primary Examiner*—Tommy P. Chin
*Assistant Examiner*—A Au
*Attorney, Agent, or Firm*—Plevy & Associates

[57] ABSTRACT

Method for operating an electrophoretic display panel in a hold mode that reduces power required, increases display life and improves performance which entails applying a voltage to the anode electrode structure during the "hold" mode of operation which is substantially lower in amplitude than the voltage applied to the anode structure during a "write" mode of operation.

9 Claims, 2 Drawing Sheets

METHOD OF OPERATION FOR REDUCING POWER, INCREASING LIFE AND IMPROVING PERFORMANCE OF EPIDS

This is a Continuation Application under 37 C.F.R. 1.62 of prior Ser. No. 08/012,739, filed on Feb. 3, 1993, which is a divisional of prior Ser. No. 07/795,659 filed Nov. 21, 1991 entitled METHOD OF OPERATION FOR REDUCING POWER, INCREASING LIFE AND IMPROVING PERFORMANCE OF EPIDS ACTIVE DEVICES.

TECHNICAL FIELD OF THE INVENTION

The present invention relates to an improved method for operating an electrophoretic display panel (EPID) for reducing power, increasing panel life and improving performance.

BACKGROUND OF THE INVENTION

Advanced electrophoretic display panels or Electrophoretic Information Displays (EPIDs) include a plurality of parallel cathode electrodes in the form of lines and a plurality of grid electrodes in the form of lines, which grid lines are transversely disposed with respect to, and insulated from, the cathode lines. The cathode lines and the grid lines are referred to as rows and columns, and the terms can be interchanged. The abovedescribed grid-cathode structure forms an X-Y matrix which enables one to address the display at each X-Y intersection (pixel) to cause pigment particles suspended in an electrophoretic fluid to migrate to an anode electrode structure. Such electrophoretic display panels have been the subject matter of many prior art patents and the assignee herein, namely CopyTele, Inc. of Huntington Station, New York, has developed many such electrophoretic display panels as well as operating techniques for such electrophoretic display panels.

As is well known to those of ordinary skill in the art, an image is formed in an electrophoretic display panel by applying potentials to predetermined intersections of the cathode, i.e., row, and grid, i.e., column, electrodes and to the anode electrode structure. This produces predetermined electric fields which cause the pigment particles associated with the display to move to the anode. Such display operation as well as techniques for fabricating such displays are provided in U.S. Pat. No. 4,655,897, entitled "Electrophoretic Display Panels and Associated Methods" issued on Apr. 7, 1987 and in U.S Pat. No. 4,850,819 entitled "Electrophoretic Display Panel Apparatus and Methods Therefor" issued on Jul. 25, 1989 For example, a 8.5"×11" electrophoretic display panel having a resolution of 200 lines per inch comprises approximately 2200 cathode or row electrodes, approximately 1700 grid or column electrodes, and an overlying anode electrode structure.

In one embodiment of an electrophoretic display panel which is described in a copending patent application entitled DUAL ANODE FLAT PANEL ELECTROPHORETIC DISPLAY, filed on May 1, 1989, Ser. No. 345,825 inventors Frank J. DiSanto and Denis A. Krusos, assigned to the assignee herein, CopyTele, Inc., now U.S. Pat. No. 5,053,763, an anode electrode structure comprises conductor strips instead of a solid, thin ITO electrode layer. In such an electrophoretic display panel which is used to display characters, characters are formed utilizing a predetermined number of such anode conductor strips in a group, the predetermined number of anode conductor strips in a character line being referred to as an anode line segment.

Thus, other EPID structures include dual anode constructions as well as those EPIDs which include mesh electrodes for improving operation and display resolution. Each display apart from its construction operates basically in three different modes. In this operation the anode electrode of the display is held at a positive voltage which typically is about 200 volts. The grid voltage is usually operated at a positive voltage, which voltage is between +2 to +5 volts at the intersection of pixels to be written. The grid voltage at the intersection of pixels which are not to be written is approximately −10 volts. The cathode under such conditions is operated at a low voltage which changes depending upon whether a pixel location is to be written into or not. This voltage goes from ground or zero volts to a voltage between +15 to +18 volts. In this manner by changing the cathode voltage from +15 volts to ground at desired pixels one can cause pigment particles to be directed towards the anode to cause a message or display to be written.

In EPIDs that utilize a mesh electrode, which is a separate individual electrode, the mesh electrode would be held at a voltage of approximately 140 volts during the write mode. In this manner, as one can ascertain, the voltage at the anode electrode, which is about 200 volts, is greater than the voltage at the mesh electrode during the write mode. Thus, in the write mode the display indicia is generated such as display characters, a picture or other indicia.

After the display is generated one may wish to remove or erase the display. Hence there is an erase mode associated with such displays. In a typical erase mode the anode voltage is directed to a source of negative potential which is typically −300 volts. In this manner all the pigment particles at the anode are caused to move away from the anode. The grid and cathode voltages in the erase operation are the same as indicated above with the grid being between +2 to +5 volts and the cathode voltage being at a low, which is ground potential. In the erase mode, all pigment particles present at the anode are directed back towards the grid to cathode structure and hence the entire image generated during the write mode is completely erased or removed during the erase mode.

There is another mode associated with the electrophoretic display and this is designated as a hold mode. In this mode an image, which was generated during the write mode, is retained during the hold mode and can continue to be displayed for extended periods of time. The held or retained image can be employed for use in facsimile or other displays. In the hold mode the anode is held at a positive voltage, which is 200 volts, the grid voltage is at a low value, which is a negative value of about −10 volts, and the cathode voltage is held at the high voltage which is between +15 to +18 volts. If the electrophoretic display is of the type having a mesh electrode, then during the hold mode the mesh electrode would be at a positive potential of 140 volts as in write mode. In a similar manner, during an erase mode if the display had a mesh electrode, the mesh electrode would be held at a negative potential of −200 volts. Electrophoretic displays of various structures are operated with the above-described potential in the various modes.

Another useful feature used with an electrophoretic display is the connection of an AC voltage to the mesh electrode during periods when the display is not being operated. The application of an AC voltage serves to agitate the pigment particles and to assure that no pigment particles remain on the mesh. In this manner, one connects the mesh electrode to an AC voltage with a magnitude of 100 volts rms at, for example, the 60 Hz line frequency. Other frequencies and amplitudes can be employed as well. In this mode the anode voltage is held at a positive voltage, as for example +200 volts, with the voltage at the grid at a low, which is −10 volts, with the voltage at the cathode purpose of applying the AC to the mesh is to remove the at the cathode high voltage, which is +15 to +18 volts. The pigment particles which remain at the mesh. The AC signal has no DC component and has equal positive and negative amplitudes.

Basically, when the EPID includes a mesh electrode during the "write" mode, pigment particles from the cathode are propelled to the anode. However, pigment particles also stick or remain at the positively charged mesh even though the anode is more positive than the mesh. If an AC voltage is applied to the mesh, then these particles are removed from the mesh. This AC voltage can be applied for a short period (100 milliseconds) during the "write" mode or after the "write" mode.

Such displays are operated so that after completion of the writing of an image the display panel has the anode voltage, which is equivalent to the voltage used in the hold mode at a high value, which, for example, is 200 volts. This value remains at that level until the image on the display is removed during the erase mode, as for example, where the anode is then directed to a negative potential of −300 volts or until another image is written into the display or the display is operated in the hold mode or power is turned off completely.

Electrophoretic displays employ pigment particles which are coated with surfactants and which are present in a liquid vehicle or suspension liquid. It has been discovered that there is an eventual decomposition of chemicals which decomposition is related to the amplitude of the current through the display and the time interval over which that current is circulating or propagating. Suffice it to say that under present conditions and techniques of manufacturing, the currents circulating in such displays are extremely small and the deterioration of such a display is very slow. Extensive life tests have been performed on such displays and these factors are shown to be true. Any reduction of current, when the image is written on the display and where the image has to be held for extended periods, is advantageous. In addition, by reducing the current the average power required by the panel during such hold conditions decreases substantially.

Thus, the present invention involves a method of operating an electrophoretic display whereby the voltages applied to the electrodes during a hold mode are extremely low, thereby greatly reducing the current in the display and thereby greatly reducing the power dissipated by the display while further increasing the effective life of the display while further improving performance in general.

It has also been determined that by the reduction of such voltages during the hold mode the overall appearance of the pigment particles appear much more pleasing in that the image and texture of the pigment changes thereby giving the image a more pleasant appearance than those images produced utilizing the above-described conventional techniques.

BRIEF DESCRIPTION OF THE DRAWINGS

A complete understanding of the present invention may be gained by considering the following detailed description in conjunction with the FIG. 1 shows in pictorial form, a cross section of a portion of an electrophoretic display panel which is operated in accordance with the method of the present invention.

DETAILED DESCRIPTION

Figure 1:
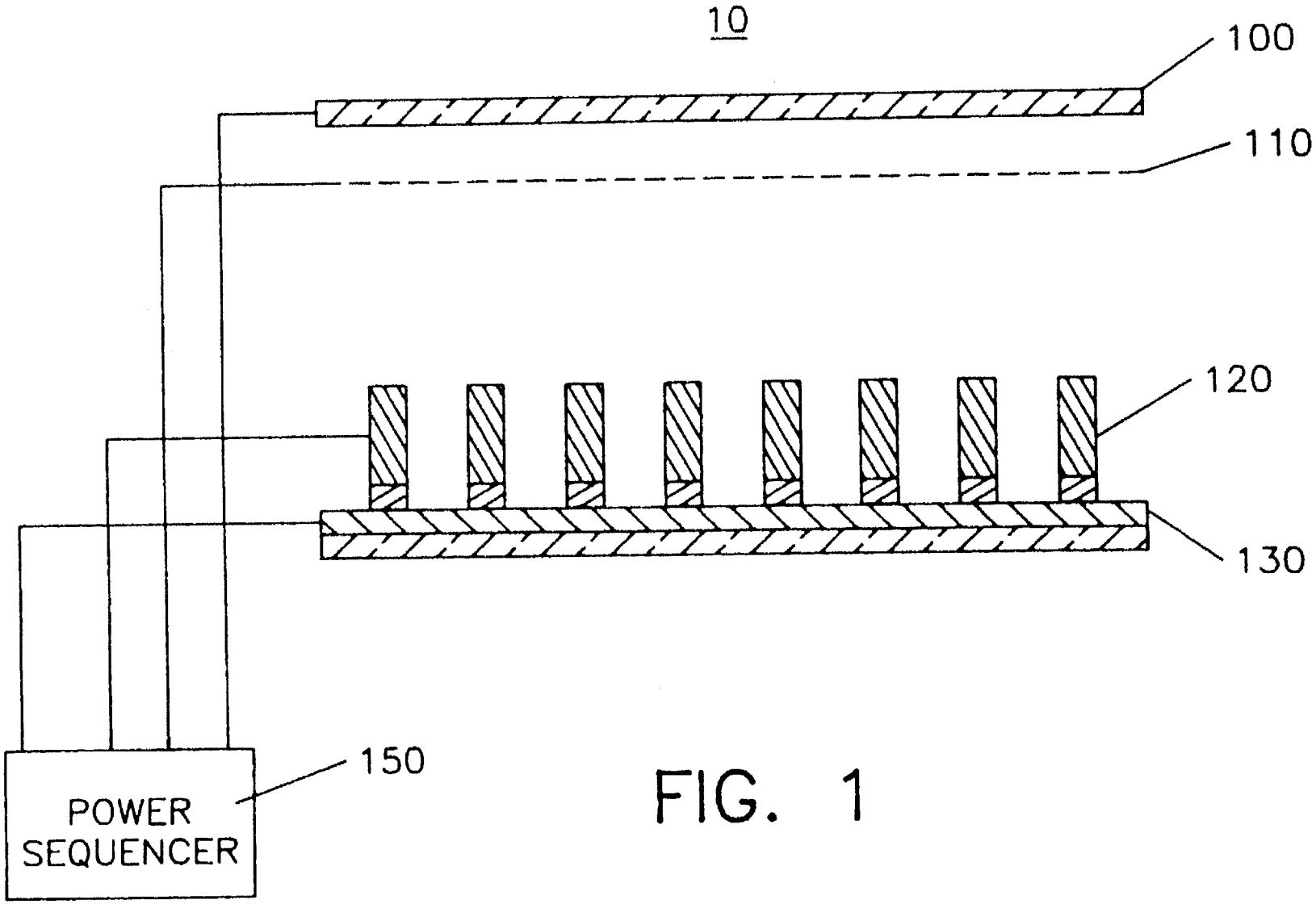

FIG. 1 shows a cross section of a portion of an electrophoretic display panel 10 which is operated in accordance with a preferred embodiment of the present invention. As shown in FIG. 1, electrophoretic display panel 10 is comprised of anode electrode structure 100, mesh structure 110 (optional and dependent upon type of EPID display), grid electrode structure 120, and cathode electrode structure 130. The mesh electrode may be omitted but is shown for the sake of completeness. Any type of EPID device can be employed with this invention. For more detail concerning the combination and operation of such displays, reference is made to the following U.S. patents all assigned to CopyTele, Inc., the assignee herein, by the inventors herein, Denis A. Krusos and Frank J. DiSanto:

- U.S. Pat. No. 5,041,824 entitled "SEMITRANSPARENT ELECTROPHORETIC INFORMATION DISPLAYS (EPID) EMPLOYING MESH LIKE ELECTRODES", issued on Aug. 20, 1991.
- U.S. Pat. No. 4,947,159 entitled "POWER SUPPLY APPARATUS CAPABLE OF MULTI-MODE OPERATION FOR AN ELECTROPHORETIC DISPLAY PANEL, issued on Aug. 7, 1990.
- U.S. Pat. No. 4,947,157 entitled "APPARATUS AND METHODS FOR PULSING THE ELECTRODES OF AN ELECTROPHORETIC DISPLAY FOR ACHIEVING FASTER DISPLAY OPERATION", issued on Aug. 7, 1990.
- U.S. Pat. No. 4,833,464 entitled "ELECTROPHORETIC INFORMATION DISPLAY (EPID) APPARATUS EMPLOYING GREY SCALE CAPABILITY, issued on May 23, 1989.
- U.S. Pat. No. 4,746,917 entitled "METHOD AND APPARATUS FOR OPERATING AN ELECTROPHORETIC DISPLAY BETWEEN A DISPLAY AND A NON-DISPLAY MODE, issued on May 24, 1988.

As known in the prior art, specific sequences of voltages are applied to anode electrode structure 100, mesh structure 110, grid electrode structure 120, and cathode electrode structure 130 to provide "write" "erase" and "hold" modes of operation. Thus the electrodes are connected to the power sequencer module 150. The module 150 is a power supply with suitable switches under digital control or otherwise to sequence the applied voltages as will be explained.

The "write" mode or the full write mode of operation is provided as indicated above by applying: (a) 200 volts to anode electrode 100; (b) 140 volts to mesh structure 110; and (c) voltage H volts to grid electrode structure 120 and voltage L volts to cathode electrode structure, where H volts and L volts are typical voltages indicated above i.e., +2 to +5 and 0 volts respecitvely. The image is written on a line to line basis for each pixel (X, Y intersection) by loading data into the grid driver circuits and sequentially operating each cathode line at the low voltage value which is about zero volts of reference potential. Hence a "1" on a grid (+2 to +5 volts) and a ground on a cathode causes a write at that pixel which is a cathode and grid line intersection. The "erase" mode of operation is provided as described above and by applying: (a) negative 300 volts to anode electrode 100; (b) negative 200 volts to mesh structure 110; and (c) voltage H volts (+2 to +5 volts) to grid electrode structure 120 and voltage L volts (0 volts) to cathode electrode structure 130.

Based on the prior art, the hold mode would be accommodated with or without a mesh electrode in such a display by leaving the anode voltage at the high value of 200 volts, leaving the mesh voltage (when there is a mesh associated with the display) at a high voltage of +140 volts, with the grid at a low voltage of −10 volts and with the cathode at a higher voltage between +15 to +18 volts. It has been discovered that one can now substantially reduce these voltages and therefore when the image is completely written the voltages during the new hold mode are as follows: the anode voltage during the new hold mode is placed at a voltage of between +1.5 to +3.0 volts. The mesh voltage is placed at the same voltage, namely +1.5 to +3.0 volts as the anode. The grid voltage is held at the low value of −10 volts with the cathode voltage held at the high value, between +15 to +18 volts. The anode voltage basically went from +200 volts to, for example, 2 volts which is a decrease of 100 times. The mesh voltage goes from +140 volts to 2 volts which is a decrease of over 70 times. This is an extremely substantial reduction in both the power dissipated and current circulated through the display during the new hold mode.

The above voltages are extremely low and totally unanticipated. Hence the power sequence 150 during the hold mode of the display automatically switches the voltages at both the anode and mesh to a value between +1.5 to ∓volts. The range of 1.5 to 3 volts is inclusive for all different types of electrophoretic displays such as those containing dual anodes, segmented anodes and so on. In any event other voltages may also suffice for these purposes. As indicated above, many displays do not have a mesh electrode and therefore the anode voltage during the hold mode would be reduced from the large value of 200 volts to a relatively small value of, for example, 1.5 to 3 volts DC.

Figure 2:
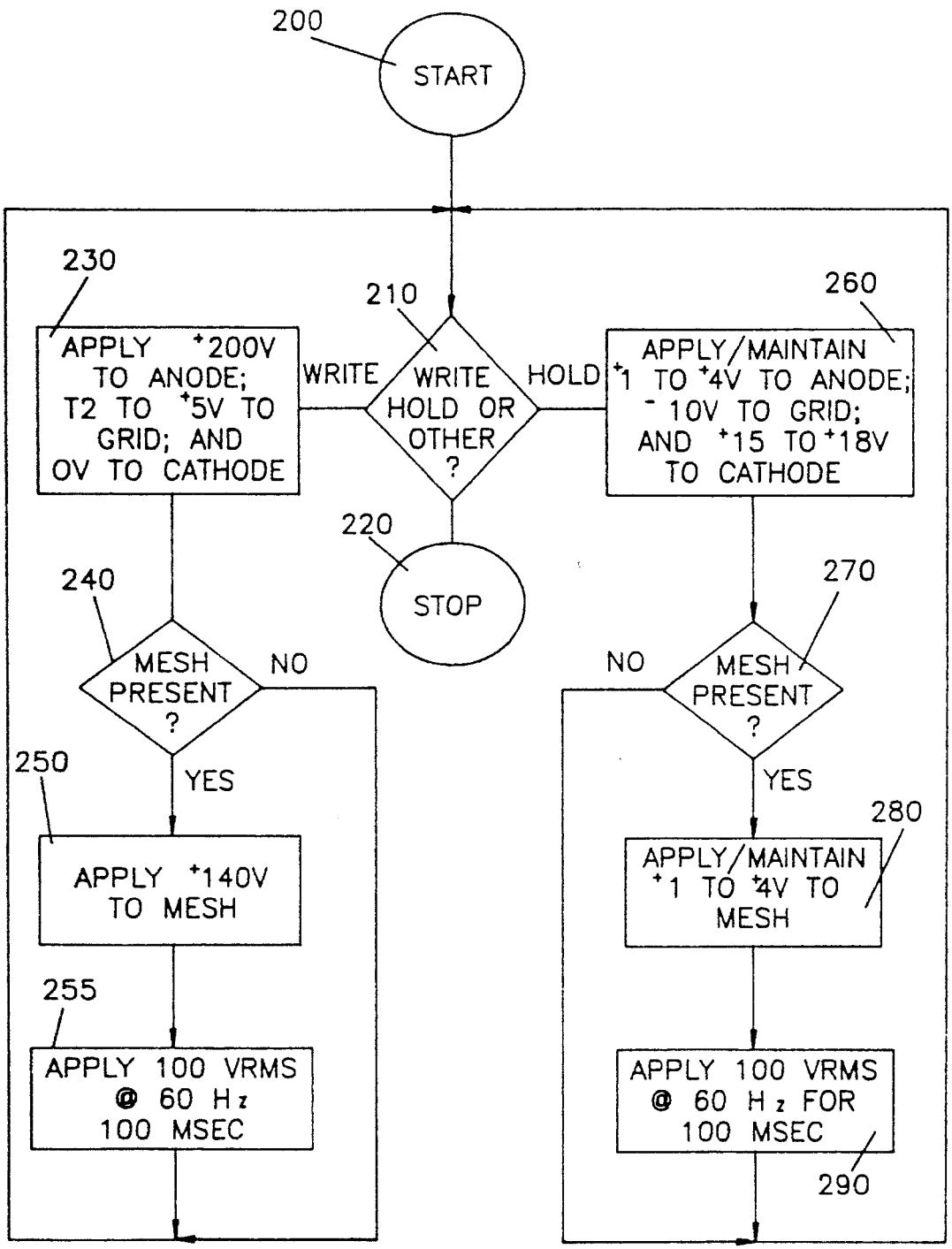
FIG. 2 is a flowchart showing voltages of the method as applied to the various electrodes during the write and hold modes.

The reduction of voltage results in a reduction of current which, as indicated, reduces the power operating characteristics of the display, increases the life of the display and improves performance during the hold mode. The lower voltages changes the appearance of the texture of the pigment, as well as the general appearance of the display. Under these hold voltages the display is extremely pleasing to view. The foregoing modes of operation in write and hold mode are depicted in FIG. 2 which is a flow chart showing the voltages applied to the various electrodes during write and hold modes. Since the invention is primarily directed to the write and hold modes and their relative voltage levels, other modes of operation for the EPID, e.g., erase mode are not depicted. After the start 200 entry point on the flow chart in FIG. 2, a decision is made at decision box 210 whether the mode selected is write, hold or other. In eventuality that it is the erase mode, the flow chart is exited 220, since such operations are not relevant to the present invention. In the eventuality that write mode is selected, instruction box 230 indicates that 200 volts are applied to the anode, +5 volts to the grid and 0 volts to the cathode, to accomplish writing. The three voltages would be applied such that they would be present simultaneously to accomplish the write function and thus are all included within box 230. Having set the voltages for the anode, grid and cathode, a decision box 240 queries as to whether there is a mesh present. If there is, instruction box 250 indicates that +140 volts is applied to the mesh. This should also be simultaneous with voltages applied in 230. As discussed above, writing may be facilitated by applying an AC voltage to the mesh for a brief period, either before or after applying the above described set of voltages 255. Having accomplished the write operation, the flow chart indicates a return to the decision box 210 to determine the nature of the next mode selected. In the event that hold mode has been selected, instruction box 260 indicates that +1 to +4 volts is applied to the anode; −10 volts to the grid; and +15 to +18 volts to the cathode. In the eventuality that there is a mesh electrode present, decision box 270, a +1 to +4 voltage is applied or maintained on the mesh as indicated by instruction box 280. As noted above, hold mode may be facilitated by applying an AC voltage to the mesh for a brief period 290. The processing is then concluded for the hold operation and processing is returned to the decision box 210.

It is of course understood that the voltages utilized in the hold mode would be totally unacceptable for writing the display and for other display operations.

What is claimed is:

1. A method of holding an image in a hold mode on an electrophoretic display panel having at least one anode electrode and a plurality of cathode and grid electrodes after the image was written by applying a first positive voltage to said at least one anode electrode, the method comprising the steps of:

applying a second positive voltage to the anode electrode;

applying a third positive voltage to a cathode electrode; and applying a negative voltage to a grid electrode; wherein said first positive voltage is at least 50 times greater than said second positive voltage.

2. A method according to claim 1, wherein said display panel comprises a plurality of anode electrodes.

3. A method according to claim 1, wherein said electrophoretic display further includes a mesh electrode, said method further includes a step of applying a fourth positive voltage to said mesh electrode.

4. A method according to claim 3, wherein said second and fourth positive voltages are applied simultaneously.

5. A method according to claim 3, wherein said second and fourth positive voltages are equal.

6. A method according to claim 5, wherein said second and fourth positive voltages are between +1.5 to 3.0 volts.

7. A method according to claim 3, wherein said first positive voltage is 70 times greater than said fourth positive voltage.

8. A method of holding an image in a hold mode on an electrophoretic display panel having an anode electrode and cathode and grid electrodes after the image was written by applying a first positive voltage to an anode electrode, the method comprising the steps of;

applying another positive voltage to the anode electrode, said step of applying said another positive voltage being performed immediately after the image was written such that particles written to the anode to make the image are retained thereon;

applying a positive voltage to a cathode electrode; and applying a negative voltage to a grid electrode, said step of applying another positive voltage occurring immediately after the image was written, wherein said first positive voltage is about 200 volts, with said another positive voltage being between 1 to 4 volts, whereby said first positive voltage is at least 50 times greater in amplitude than said another positive voltage.

9. A method of holding an image on an electrophoretic display panel after the image was written by applying a first positive voltage to an anode electrode, the method comprising the steps of:

applying another positive voltage to the anode electrode;

applying a positive voltage to a cathode electrode; and applying a negative voltage to a grid electrode, wherein the amplitude of said another positive voltage is substantially lower than the amplitude of the first positive voltage, whereby pigment particles written to the anode to make the image are retained thereon, and wherein said first positive voltage is about 200 volts, with said another positive voltage being between 1 to 4 volts, whereby said first positive voltage is at least 50 times greater than said another positive voltage.

* * * * *